US006225761B1

(12) United States Patent
Dworsky et al.

(10) Patent No.: US 6,225,761 B1
(45) Date of Patent: May 1, 2001

(54) FIELD EMISSION DISPLAY HAVING AN OFFSET PHOSPHOR AND METHOD FOR THE OPERATION THEREOF

(75) Inventors: Lawrence N. Dworsky, Scottsdale; Curtis D. Moyer, Phoenix, both of AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/406,410

(22) Filed: Sep. 27, 1999

(51) Int. Cl.[7] ..... G09G 1/04; H01J 1/62

(52) U.S. Cl. ..... 315/366; 315/382; 313/495; 313/497

(58) Field of Search ..... 315/366, 375, 315/382, 350; 313/495, 497, 496, 309, 310, 334, 335, 336

(56) References Cited

U.S. PATENT DOCUMENTS 5,543,691 8/1996 Palevsky et al. ..... 315/366
5,548,181 * 8/1996 Jones ..... 313/495
5,783,904 * 7/1998 Liu et al. ..... 313/495
5,986,399 * 11/1999 Van Veen et al. ..... 313/495
5,998,923 12/1999 Jäger ..... 313/495

* cited by examiner

*Primary Examiner*—Don Wong
*Assistant Examiner*—Hoang Nguyen
(74) *Attorney, Agent, or Firm*—S. Kevin Pickens; Kevin D. Wills

(57) ABSTRACT

A field emission display (100, 200, 300) includes a plurality of offset phosphors (126) and a cathode plate (110). Cathode plate (110) has a plurality of non-electron-emissive structures (112), a plurality of electron-emissive pixels (108), and a plurality of focusing electrodes (106). Offset phosphors (126) are aligned one each with non-electron-emissive structures (112) of cathode plate (110). Focusing electrodes (106) are disposed to cause a plurality of emission currents (134), which are generated by electron-emissive pixels (108), to be directed one each toward offset phosphors (126). Ions liberated from offset phosphors (126) are received by non-electron-emissive structures (112) of cathode plate (110), thereby ameliorating ion bombardment of electron-emissive pixels (108).

22 Claims, 1 Drawing Sheet

FIELD EMISSION DISPLAY HAVING AN OFFSET PHOSPHOR AND METHOD FOR THE OPERATION THEREOF

FIELD OF THE INVENTION

The present invention relates, in general, to field emission displays and, more particularly, to field emission displays having focusing electrodes.

BACKGROUND OF THE INVENTION

It is known in the art that the electron emitters of a field emission display can become contaminated and/or dulled due to bombardment by ions. Such ions typically are liberated from the cathodoluminescent phosphors when the phosphors are activated by the field-emitted electrons.

One prior art scheme for addressing this problem of ion bombardment is taught in U.S. Pat. No. 5,543,691, entitled "Field Emission Display with Focus Grid and Method of Operating Same", by Palevsky et al. Palevsky et al teach providing a focus grid disposed between the anode and the cathode. Palevsky et al teach that the focus grid can have an aperture that is offset from the electron emitters, so that the field-emitted electrons will be imaged to a point on the phosphor anode that is not in line with the focus grid aperture. Palevsky et al teach that ions, which are generated at the anode, are intercepted by the focus grid and do not reach the cathode.

However, a disadvantage of this prior art scheme is that the focus grid has a large number of electrons impinging on it, and these electrons tend to generate low voltage secondary electrons. A percentage of these secondary electrons drift into the focus grid aperture and are then accelerated by the anode. Palevsky et al teach reducing the effect of secondary electrons by coating the surface of the focus grid with a material that has a reduced secondary emission coefficient. However, this solution adds an additional fabrication step in the fabrication of the focus grid.

Palevsky et al further teach reducing the effect of secondary electrons by placing a second focus grid between the focus grid and the anode. This solution adds additional fabrication and alignment steps in the fabrication of the field emission display. Also, Palevsky et al teach that in the operation of the display, the second focus grid is biased negatively with respect to the first focus grid, so that the low energy secondary electrons from the first focus grid are repelled by the second focus grid while the higher energy electrons from the cathode will have enough energy to pass through to the anode. Thus, the electrons from the cathode are made less energetic. By reducing the velocity of the electrons, the brightness of the display is compromised.

Furthermore, the focus grid described by Palevsky et al is not connected to the cathode. Rather, support is only provided along the edges of the focus grid. Thus, the focus grid may be prone to bowing or sagging.

Accordingly, there exists a need for an improved field emission display, which overcomes at least these shortcomings of the prior art.

BRIEF DESCRIPTION OF THE DRAWINGS

Referring to the drawings.

Figure 1:
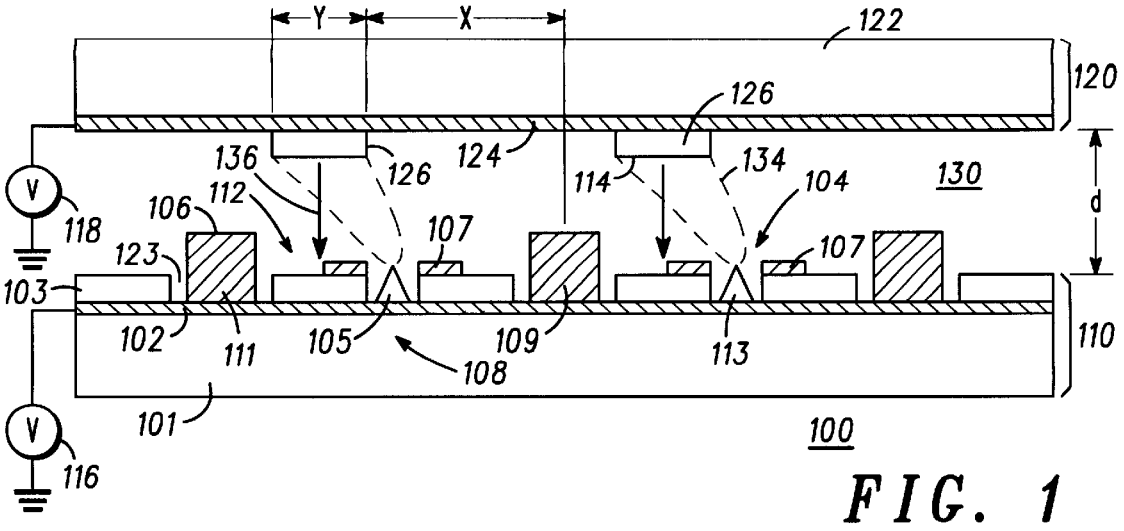
FIG. 1 is a cross-sectional view of a field emission display, in accordance with a preferred embodiment of the invention.

It will be appreciated that for simplicity and clarity of illustration, elements shown in the drawings have not necessarily been drawn to scale. For example, the dimensions of some of the elements are exaggerated relative to each other. Further, where considered appropriate, reference numerals have been repeated among the drawings to indicate corresponding elements.

DESCRIPTION OF THE PREFERRED EMBODIMENTS

The invention is for a field emission display (FED) having a plurality of offset phosphors. Each offset phosphor is aligned with a non-electron-emissive structure of the cathode plate. By "aligned with" it is meant that the offset phosphor opposes the non-electron-emissive structure and does not oppose any of the electron emitter structures of the FED, which are used to create the display image. The FED of the invention further includes a plurality of focusing electrodes and a plurality of electron-emissive pixels defined by the electron emitter structures. The focusing electrodes are useful for directing toward the offset phosphors the emission currents generated by the electron-emissive pixels.

The FED of the invention is operated and configured to cause ions, which are liberated from the offset phosphors, to be directed toward the non-electron-emissive structures of the cathode plate, rather than toward the electron-emissive pixels, thereby ameliorating ion bombardment of the electron emitter structures. Furthermore, no appreciable fraction of the emission currents is intercepted by the focusing electrodes, thereby reducing or eliminating the generation of secondary electrons, as contrasted with a prior art FED, which has a focusing grid disposed between the anode plate and the cathode plate.

FIG. 1 is a cross-sectional view of a field emission display (FED) 100, in accordance with a preferred embodiment of the invention. FED 100 includes a cathode plate 110 and an anode plate 120. Anode plate 120 is spaced apart from cathode plate 110 to define an interspace region 130 therebetween. The separation distance, d, between cathode plate 110 and anode plate 120 is preferably about 1 millimeter.

Cathode plate 110 includes a substrate 101, which can be made from glass, silicon, and the like. A cathode 102 is disposed upon substrate 101. Cathode 102 is connected to a first independently controlled voltage source 116. A dielectric layer 103 is disposed upon cathode 102 and further defines a plurality of emitter wells 104.

An electron emitter structure 105, such as a Spindt tip, is disposed in each of emitter wells 104. Electron emitter structures 105 are the electron-emissive structures of cathode plate 110, which are useful for generating the display image.

A plurality of gate extraction electrodes 107 are disposed on dielectric layer 103 proximate to electron emitter structures 105. Gate extraction electrodes 107 are connected to a second independently controlled voltage source (not shown). The selectively addressable unit of cathode plate 110 is an electron-emissive pixel 108. Each of electron-emissive pixels 108 is located at a section of gate extraction electrodes 107 that overlaps cathode 102. Each of electron-emissive pixels 108 can include any number of electron emitter structures 105. For ease of understanding, in FIG. 1, each of electron-emissive pixels 108 is represented by only one of electron emitter structures 105. By applying the appropriate potentials to cathode 102 and gate extraction electrodes 107, each of electron-emissive pixels 108 can be caused to generate an emission current 134.

Each of electron emitter structures 105 has an electron-emissive tip 113, from which the electrons are emitted. If electron-emissive tip 113 becomes dulled or contaminated, emission current 134 is compromised. As contrasted with prior art FED's, FED 100 of the invention reduces the extent of blunting and contamination of electron-emissive tips 113, due to bombardment by ions, which may originate from a plurality of offset phosphors 126.

Offset phosphors 126 are disposed on an anode 124 of anode plate 120. Anode 124 is disposed on a transparent substrate 122 of anode plate 120. Transparent substrate 122 is made from a hard, transparent material, such as, for example, soda lime glass. Anode 124 is preferably made from a transparent, conductive material, such as indium tin oxide. Anode 124 is connected to a third independently controlled voltage source 118. Methods for fabricating anode plates for matrix-addressable FED's are known to one of ordinary skill in the art.

Each of offset phosphors 126 is made from a cathodoluminescent material and is disposed to receive electrons emitted by one of electron-emissive pixels 108. Preferably, each of offset phosphors 126 receives electrons that are emitted by the one of electron-emissive pixels 108, which is closest to it.

At each of offset phosphors 126, the electrons are received at an electron-receiving surface 114. In general and in accordance with the invention, at least the electron-receiving surface of the surface defined by the offset phosphor is aligned with a non-electron-emissive structure of the cathode plate. Thus, in the embodiment of FIG. 1, electron-receiving surface 114 of offset phosphor 126 is aligned with a non-electron-emissive structure 112 of cathode plate 110.

In general, each non-electron-emissive structure includes one or more structures of the cathode plate, excluding the electron emitter structures that are used for creating the display image. Thus, in the embodiment of FIG. 1, each of non-electron-emissive structures 112 includes a portion of gate extraction electrodes 107 and a portion of dielectric layer 103 and does not include any of electron emitter structures 105.

Herein, the phrase "aligned with" a structure means opposing the structure and not opposing any of the electron emitter structures, which are used to generate the display image. Thus, the phrase "electron-receiving surface 114 is aligned with non-electron-emissive structure 112" means that electron-receiving surface 114 opposes non-electron-emissive structure 112 and does not oppose any of electron emitter structures 105.

In the embodiment of FIG. 1, the entirety of the surface of offset phosphor 126, which opposes cathode plate 110, defines electron-receiving surface 114. Thus, in the embodiment of FIG. 1, offset phosphor 126 is aligned with non-electron-emissive structure 112.

Further in accordance with the invention, cathode plate 110 has a plurality of focusing electrodes 106. Focusing electrodes 106 are useful for causing each of emission currents 134 to be directed toward one of offset phosphors 126. The electrons of emission current 134 strike electron-receiving surface 114 of offset phosphor 126, thereby liberating ions, which are represented by arrows 136 in FIG. 1, from offset phosphor 126.

The ions are not directed toward electron emitter structures 105. Rather, the ions travel toward and are received by non-electron-emissive structure 112. This is due, in part, to the relatively large mass of the ions, as contrasted with the mass of the electrons; the small value of separation distance, d, between anode plate 120 and cathode plate 110; and the values of the voltages that are applied to the electrodes.

Corresponding to each of electron-emissive pixels 108, there are provided a first focusing electrode 109 and a second focusing electrode 111. First focusing electrode 109 is spaced apart from electron-emissive pixel 108 to define a first separation distance, x. Second focusing electrode 111 is spaced apart from electron-emissive pixel 108 to define a second separation distance, y. In accordance with the invention, first separation distance, x, second separation distance, y, the voltage applied to first focusing electrode 109, and the voltage applied to second focusing electrode 111 are selected so that emission current 134 is caused to be received by electron-receiving surface 114 of offset phosphor 126. The height and width of first and second focusing electrodes 109 and 111 are also selected to cause emission current 134 to be received by electron-receiving surface 114 of offset phosphor 126.

In the embodiment of FIG. 1, first focusing electrode 109 and second focusing electrode 111 are both connected to cathode 102 and, therefore, are at the same potential. This potential is preferably equal to about ground potential. Also in the embodiment of FIG. 1, the width and height of first focusing electrode 109 are equal to the width and height, respectively, of second focusing electrode 111. Preferably, each of first and second focusing electrodes 109 and 111 extends about 50 micrometers above the surface of dielectric layer 103 and has a width of about 10 micrometers. These values are dependent upon the voltages used and the precise layout of FED 100.

Also, the voltage at gate extraction electrodes 107 for causing electron emission is preferably equal to about 80 volts, and the voltage at anode 124 is preferably equal to about 3000 volts. For these voltage and geometric configurations, first separation distance, x, is selected to be less than second separation distance, y, in order to cause emission current 134 to be directed toward electron-receiving surface 114 of offset phosphor 126.

Methods for fabricating cathode plates for matrix-addressable FED's are known to one of ordinary skill in the art. The fabrication of cathode plate 110 includes the additional step of selectively removing portions of dielectric layer 103 to define a plurality of vias 123, into which are deposited a conductive material to form focusing electrodes 106. The conductive material from which focusing electrodes 106 are made can be the same material from which cathode 102 is made.

Figure 2:
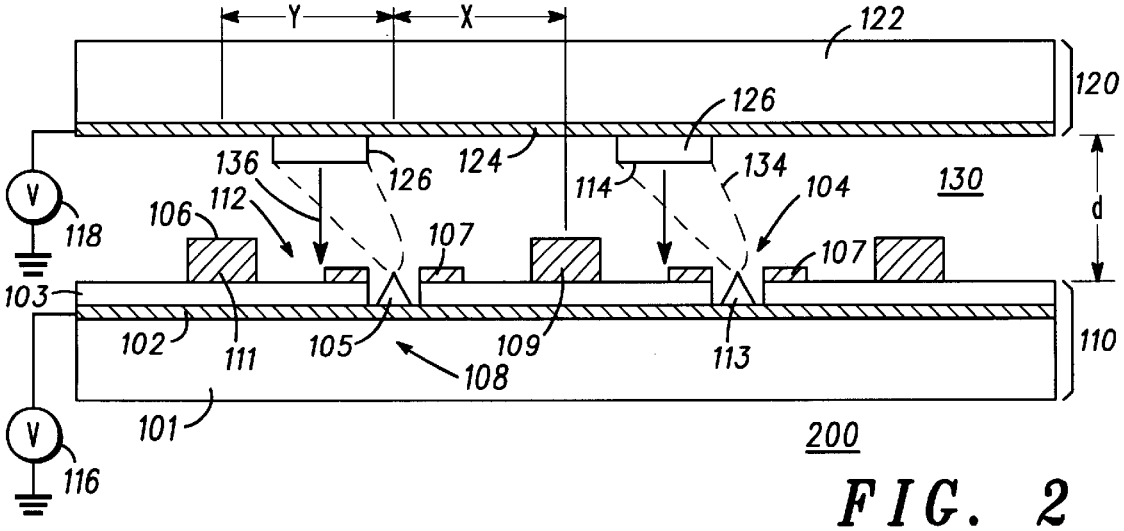
FIG. 2 is a cross-sectional view of a field emission display, in accordance with another embodiment of the invention.

FIG. 2 is a cross-sectional view of a field emission display (FED) 200, in accordance with another embodiment of the invention. The embodiment of FIG. 2 differs from the embodiment of FIG. 1 in that focusing electrodes 106 are disposed on dielectric layer 103 and in that dielectric layer 103 does not define vias for the placement of focusing electrodes 106. Furthermore, in the embodiment of FIG. 2, focusing electrodes 106 need not be connected to cathode 102.

In the embodiment of FIG. 2, first focusing electrode 109 can be connected to a voltage source (not shown) that is independently controlled from a voltage source (not shown), which is connected to second focusing electrode 111. Alternatively, first focusing electrode 109 and second focusing electrode 111 can be connected to a common voltage source (not shown).

Methods for fabricating cathode plates for matrix-addressable FED's are known to one of ordinary skill in the art. The fabrication of cathode plate 110 of the embodiment of FIG. 2 includes the additional step of patterning a convenient conductive material onto dielectric layer 103 for forming focusing electrodes 106.

Figure 3:
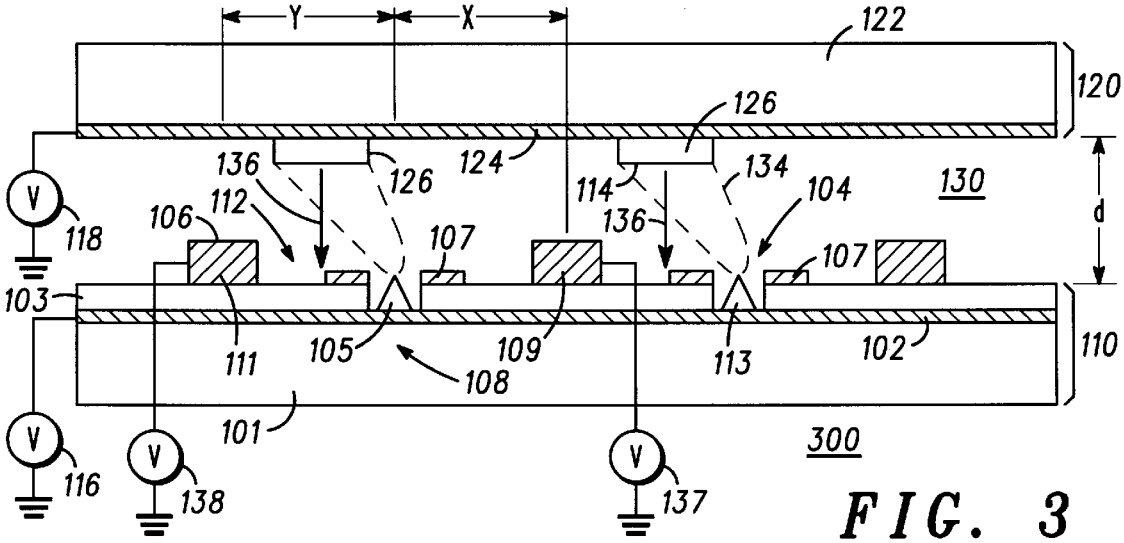
FIG. 3 is a cross-sectional view of a field emission display, in accordance with still another embodiment of the invention.

FIG. 3 is a cross-sectional view of a field emission display (FED) 300, in accordance with still another embodiment of the invention. Similar to the embodiment of FIG. 2, focusing electrodes 106 of the embodiment of FIG. 3 are disposed on dielectric layer 103. The embodiment of FIG. 3 is distinguished from the embodiments of FIGS. 1 and 2 in that first separation distance, x, is about equal to second separation distance, y.

Furthermore, in the embodiment of FIG. 3, first focusing electrode 109 is connected to a fourth independently controlled voltage source 137, and second focusing electrode 111 is connected to a fifth independently controlled voltage source 138. These connections are represented schematically in FIG. 3. Thus, the potentials at first focusing electrode 109 and second focusing electrode 111 can be independently selected for causing emission current 134 to be directed toward electron-receiving surface 114.

The embodiment of FIG. 3 is also distinguished from the embodiments of FIGS. 1 and 2 in that non-electron-emissive structure 112 further includes a portion of focusing electrodes 106. That is, electron-receiving surface 114 further opposes a portion of focusing electrodes 106.

In summary, the invention is for a field emission display (FED) having offset phosphors and a cathode plate, which has focusing electrodes, and a method for the operation thereof. Each offset phosphor is aligned with a non-electron-emissive structure of the cathode plate. The focusing electrodes direct the emission currents toward the electron-receiving surfaces of the offset phosphors. The FED of the invention is operated and configured to cause ions, which are liberated from the offset phosphors, to be directed toward the non-electron-emissive structures of the cathode plate, rather than toward the electron-emissive pixels, thereby ameliorating ion bombardment of the electron emitter structures. Furthermore, no appreciable fraction of the emission currents is intercepted by the focusing electrodes, thereby reducing or eliminating the generation of secondary electrons, as contrasted with a prior art FED, which has a focusing grid disposed between the anode plate and the cathode plate.

While we have shown and described specific embodiments of the present invention, further modifications and improvements will occur to those skilled in the art. For example, the invention is also embodied by a display in which only one of the first and second focusing electrodes is connected to the cathode. As a further example, the invention is embodied by a display in which the width and/or the height of the first focusing electrode differ(s) from the width and/or height, respectively, of the second focusing electrode. As yet a further example, the invention is embodied by a display in which the electron-receiving surface of the offset phosphor is aligned only with the gate extraction electrode or only with the dielectric layer or only with a focusing electrode.

We desire it to be understood, therefore, that this invention is not limited to the particular forms shown, and we intend in the appended claims to cover all modifications that do not depart from the spirit and scope of this invention.

We claim:

1. A field emission display comprising:

a cathode plate having a plurality of non-electron-emissive structures and a plurality of electron-emissive pixels;

a plurality of offset phosphors aligned one each with the plurality of non-electron-emissive structures of the cathode plate; and the cathode plate further having focusing means for causing a plurality of emission currents generated by the plurality of electron-emissive pixels to be directed one each toward the plurality of offset phosphors whereby ions liberated from the plurality of offset phosphors are received by the plurality of non-electron-emissive structures, thereby ameliorating ion bombardment of the plurality of electron-emissive pixels.

2. The field emission display as claimed in claim 1, wherein each of the plurality of non-electron-emissive structures comprises at least one of a portion of a gate extraction electrode, a portion of a dielectric layer, and a portion of the focusing means.

3. A field emission display comprising:

a plurality of offset phosphors; and a cathode plate having a plurality of non-electron-emissive structures, a plurality of electron-emissive pixels, and a plurality of focusing electrodes, wherein the plurality of offset phosphors are aligned one each with the plurality of non-electron-emissive structures of the cathode plate, and wherein the plurality of focusing electrodes are disposed to cause a plurality of emission currents generated by the plurality of electron-emissive pixels to be directed one each toward the plurality of offset phosphors whereby ions liberated from the plurality of offset phosphors are received by the plurality of non-electron-emissive structures of the cathode plate, thereby ameliorating ion bombardment of the plurality of electron-emissive pixels.

4. The field emission display as claimed in claim 3, wherein each of the plurality of non-electron-emissive structures comprises at least one of a portion of a gate extraction electrode, a portion of a dielectric layer, and a portion of the plurality of focusing electrodes.

5. A field emission display comprising:

an offset phosphor having an electron-receiving surface;

a non-electron-emissive structure, wherein the electron-receiving surface of the offset phosphor is aligned with the non-electron-emissive structure;

an electron-emissive pixel coextensive with the non-electron-emissive structure and designed to emit an emission current;

a first focusing electrode spaced apart from the electron-emissive pixel to define a first separation distance; and a second focusing electrode spaced apart from the electron-emissive pixel to define a second separation distance, wherein the first and second focusing electrodes are disposed to cause the emission current to be received by the electron-receiving surface of the offset phosphor.

6. The field emission display as claimed in claim 5, wherein the first separation distance is less than the second separation distance.

7. The field emission display as claimed in claim 5, wherein the first separation distance is about equal to the second separation distance.

8. The field emission display as claimed in claim 5, further comprising a cathode connected to the electron-emissive pixel, and wherein the first focusing electrode is connected to the cathode.

9. The field emission display as claimed in claim 8, wherein the second focusing electrode is connected to the cathode.

10. The field emission display as claimed in claim 5, further comprising a cathode connected to the electron-emissive pixel, further comprising a dielectric layer disposed on the cathode, and wherein at least one of the first focusing electrode and the second focusing electrode is disposed on the dielectric layer.

11. The field emission display as claimed in claim 5, wherein the first focusing electrode is designed to be connected to a first independently controlled voltage source, and wherein the second focusing electrode is designed to be connected to a second independently controlled voltage source.

12. A field emission display comprising:

a cathode;

a dielectric layer disposed on the cathode and defining a plurality of emitter wells;

a plurality of electron emitter structures disposed one each within the plurality of emitter wells and connected to the cathode, wherein the plurality of electron emitter structures define an electron-emissive pixel;

a gate extraction electrode disposed on the dielectric layer proximate to the plurality of electron emitter structures;

a first focusing electrode spaced apart from the electron-emissive pixel to define a first separation distance;

a second focusing electrode spaced apart from the electron-emissive pixel to define a second separation distance, wherein at least one of the gate extraction electrode, the dielectric layer, the first focusing electrode, and the second focusing electrode defines a non-electron-emissive structure; and an offset phosphor opposing the non-electron-emissive structure and not opposing the electron-emissive pixel.

13. The field emission display as claimed in claim 12, wherein the first separation distance is less than the second separation distance.

14. The field emission display as claimed in claim 12, wherein the first separation distance is about equal to the second separation distance.

15. The field emission display as claimed in claim 12, wherein the first focusing electrode is connected to the cathode.

16. The field emission display as claimed in claim 15, wherein the second focusing electrode is connected to the cathode.

17. The field emission display as claimed in claim 12, wherein at least one of the first focusing electrode and the second focusing electrode is disposed on the dielectric layer.

18. The field emission display as claimed in claim 12, wherein the first focusing electrode is designed to be connected to a first independently controlled voltage source, and wherein the second focusing electrode is designed to be connected to a second independently controlled voltage source.

19. A method for operating a field emission display having a cathode plate, wherein the cathode plate has a non-electron-emissive structure and an electron-emissive pixel, the method comprising the steps of:

providing an offset phosphor having an electron-receiving surface;

causing the electron-emissive pixel to emit an emission current;

causing the emission current to be received by the electron-receiving surface of the offset phosphor, thereby liberating a plurality of ions from the offset phosphor; and causing the plurality of ions to be received by the non-electron-emissive structure of the cathode plate and not by the electron-emissive pixel of the cathode plate.

20. The method for operating a field emission display as claimed in claim 19, further comprising the step of aligning the electron-receiving surface of the offset phosphor with the non-electron-emissive structure of the cathode plate.

21. The method for operating a field emission display as claimed in claim 19, wherein the step of causing the emission current to be received by the electron-receiving surface of the offset phosphor comprises the steps of:

providing a first focusing electrode spaced apart from the electron-emissive pixel;

providing a second focusing electrode spaced apart from the electron-emissive pixel;

applying a first voltage to the first focusing electrode;

applying a second voltage to the second focusing electrode; and selecting the first voltage and the second voltage so that the emission current is caused to be received by the electron-receiving surface of the offset phosphor.

22. The method for operating a field emission display as claimed in claim 21, wherein the first voltage is not equal to the second voltage.

* * * * *